US007661475B2

(12) United States Patent
Sheiretov et al.

(10) Patent No.: US 7,661,475 B2
(45) Date of Patent: Feb. 16, 2010

(54) DRILL PIPE CONVEYANCE SYSTEM FOR SLIM LOGGING TOOL

(75) Inventors: Todor K. Sheiretov, Houston, TX (US); Matthew McCoy, Sugar Land, TX (US); Chris Del Campo, Houston, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 61 days.

(21) Appl. No.: 11/753,192

(22) Filed: May 24, 2007

(65) Prior Publication Data

US 2008/0202767 A1 Aug. 28, 2008

Related U.S. Application Data

(60) Provisional application No. 60/891,775, filed on Feb. 27, 2007.

(51) Int. Cl.
*E21B 47/12* (2006.01)

(52) U.S. Cl. ..... 166/254.2; 175/50

(58) Field of Classification Search ..... 166/254.2, 166/481, 65.1, 381; 175/50
See application file for complete search history.

(56) References Cited

U.S. PATENT DOCUMENTS

| | | | | |
|---|---|---|---|---|
| 2,719,361 | A | 10/1955 | Montgomery | |
| 2,719,363 | A | 10/1955 | Montgomery | |
| 2,726,848 | A | 12/1955 | Montgomery | |
| 4,041,780 | A | 8/1977 | Angehrn | |
| 4,457,370 | A | 7/1984 | Wittrisch | |
| 4,597,440 | A | 7/1986 | Pottier | |
| 4,715,446 | A * | 12/1987 | Wittrisch | 166/381 |
| 5,217,075 | A * | 6/1993 | Wittrisch | 166/302 |
| 5,433,276 | A | 7/1995 | Martain et al. | |
| 6,269,891 | B1 | 8/2001 | Runia | |
| 6,311,777 | B1 | 11/2001 | Milne et al. | |
| 6,419,013 | B1 | 7/2002 | Milne et al. | |
| 6,488,085 | B1 | 12/2002 | Milne et al. | |
| 6,557,631 | B1 | 5/2003 | Spencer et al. | |
| 6,578,631 | B2 | 6/2003 | Milne et al. | |
| 6,755,257 | B2 | 6/2004 | Spencer et al. | |
| 6,834,719 | B2 | 12/2004 | Fritchley et al. | |
| 7,134,493 | B2 | 11/2006 | Runia | |
| 7,201,231 | B2 | 4/2007 | Chaplin et al. | |
| 7,215,125 | B2 * | 5/2007 | Clark | 324/368 |
| 2004/0118611 | A1 | 6/2004 | Runia et al. | |
| 2004/0238218 | A1 | 12/2004 | Runia et al. | |
| 2006/0118298 | A1 | 6/2006 | Millar et al. | |

FOREIGN PATENT DOCUMENTS

WO 2004094783 A1 11/2004

* cited by examiner

*Primary Examiner*—William P Neuder
(74) *Attorney, Agent, or Firm*—Rodney Warfford; David Cate; Jaime Castano

(57) ABSTRACT

A well logging instrument deployment device includes a housing configured to be coupled to a pipe string. A carrier sub is disposed inside the housing and configured to move longitudinally inside the housing. At least one well logging instrument is coupled to the carrier sub. A latch is configured to retain the well logging instrument and carrier sub in a first longitudinal position along the housing such that the well logging instrument is disposed entirely inside the housing. The latch is configured to retain the well logging instrument and carrier in a second position such that at least a portion of the well logging instrument extends outwardly from the housing.

19 Claims, 3 Drawing Sheets

DRILL PIPE CONVEYANCE SYSTEM FOR SLIM LOGGING TOOL

CROSS-REFERENCE TO RELATED APPLICATIONS

This application claims priority from and the benefit of U.S. Provisional Patent Application No. 60/891,775, filed Feb. 27, 2007.

STATEMENT REGARDING FEDERALLY SPONSORED RESEARCH OR DEVELOPMENT

Not applciable.

BACKGROUND OF THE INVENTION

1. Field of the Invention

The invention relates generally to the field of well logging conveyance methods and apparatus. More specifically, the invention relates to methods and devices for conveying well logging instruments through a wellbore where conditions may make downward movement of the instruments in the wellbore unsuitable.

2. Background Art

Electric wireline wellbore logging instruments are used for, among other things, making measurements of various physical properties of earth formations penetrated by wellbores. Electric wireline logging instruments are typically inserted into the wellbore by the force of gravity, and are returned to the earth's surface by means of an armored electrical cable attached to the instrument. The cable is drawn by a winch or similar spooling apparatus.

Certain wellbores are drilled so as to have very large inclination from vertical over at least a portion of the wellbore. Other wellbores can have a section which is substantially horizontal. Still other wellbores may be drilled through formations that are subject to swelling or caving, or may have fluid pressures therein that make passage of well logging instruments past them that are unsuitable for typical well logging instrument conveyance techniques. Gravity cannot be used to insert well logging instruments into such wellbores, so various methods have been devised to insert well logging instruments into such wellbores.

One of the methods known in the art for inserting well logging instruments into highly inclined or horizontal wellbores is to attach the well logging instruments to the end of a pipe comprising threaded sections ("drill pipe" or "tubing"), and to lower the pipe into the wellbore by threadedly attaching additional sections to the pipe at the upper end thereof. After the well logging instruments are inserted to a desired depth in the wellbore, an electrical cable is attached to the upper end of the well logging instruments, typically by pumping the cable through the center of the pipe until the cable latches onto a special electrical and mechanical connector disposed at the top of the well logging instruments. The cable can be inserted into the center of the pipe from the outside of the pipe through a device called a "side entry sub." A side entry sub is a short section of pipe having a sealable opening through a side wall of the section of pipe, which enables passage of the cable through the wall of the pipe section. The side entry sub is typically assembled to the pipe at a substantial distance below the upper end of the pipe. Assembled in this position, the side entry sub enables raising the well logging instruments within the wellbore (or withdrawing them from the wellbore) by removing section from the pipe simultaneously with spooling of the cable as the logging instruments are raised in or withdrawn from the wellbore. By such procedure, portions of the wellbore can be measured with the well logging instrument without repeated insertion and removal of the cable from the inside of the pipe.

A drawback to using pipe to convey the well logging instruments using procedures known in the art is the presence of the cable outside the pipe from the position of the side entry sub up to the earth's surface. In some cases control of fluids which may be present in the wellbore requires using equipment located at the earth's surface designed to seal an annular space between the pipe and the wellbore. In other cases it is necessary to maintain fluid pressure on the wellbore from the earth's surface in order to obtain valid measurements from the instruments disposed in the wellbore. Cable disposed outside the pipe disturbs the operation of the sealing equipment and makes it difficult to seal the wellbore for maintaining fluid pressure.

Well logging instruments are also known in the art to be inserted into the wellbore by using a coiled tubing having a coaxially inserted electrical cable. Because the cable is coaxially inserted through the coiled tubing, it is possible to seal the annular space between the wellbore and the coiled tubing with equipment similar to that used to seal the annular space outside the sectioned pipe.

U.S. Pat. No. 5,433,276 issued to Martain et al. described a method and apparatus for inserting electric wireline logging instruments into a wellbore using an apparatus comprising pipe assembled from sections and coiled tubing having a coaxially inserted armored electrical cable ("wireline"). The method includes the steps of attaching a first part of a submersible electrical connector to one end of the coiled tubing and to the wireline inside the coiled tubing. A second part of the submersible connector is attached to one end of the wireline tools. A first part of a selectively operable latching mechanism is attached to the same end of the wireline logging instruments. A second part of the latching mechanism forms part of a latching sub which is attached to one end of the pipe. The well logging instruments are attached to the pipe by engaging the first and second parts of the latching mechanism, and the instruments are inserted into the wellbore to a predetermined depth by assembling the sections of the pipe. The coiled tubing is then inserted into the interior of the pipe until the submersible connector is engaged. The latching mechanism is selectively operated to release the well logging instruments from the sub, and the coiled tubing is inserted further into the wellbore until the well logging instruments reach a desired depth. The coiled tubing is then withdrawn until the instruments engage the sub. The latching mechanism is then selectively operated so that the well logging instruments are attached to the sub. The coiled tubing is then withdrawn from the pipe, which disengages the submersible connector. The well logging instruments are then withdrawn from the wellbore by disassembling the sections of the pipe.

U.S. Pat. No. 4,041,780 issued to Angehrn describes a self-contained, battery powered well logging instrument that can be pumped down the interior of a drill pipe string having a catcher sub at its lower end. When the well logging instrument latches into the catcher sub, the pumped fluid circulation is blocked, after which increased pump pressure switches a valve assembly to recreate circulation and energize the well logging instrument to a "standby" position. An accelerometer in the well logging instrument detects the upward movement of the well logging instrument and switches the circuitry from standby to a "record" mode. The output from a clock controlled by the downhole accelerometer is recorded along with the logging information (measurements of formation properties) measured by sensors on the well logging instrument and is synchronized with pipe footage measurements and with a similar such accelerometer and clock at the Earth's surface which are responsive to the movement of the pipe string at the Earth's surface. The recorded logging measurements are thus related to wellbore depth by correlating with the data simultaneously recorded at the Earth's surface. As an alternative embodiment, the well logging instrument is attached to the drill pipe prior to running the pipe into the wellbore.

U.S. Pat. No. 4,597,440 issued to Pottier and assigned to the assignee of the present invention describes a method for displacing a well logging instrument through a non-gravity descent portion of a wellbore such as a highly deviated portion. The disclosed method includes assembling a well logging instrument at the lower end of a drill pipe as an exposed extension to the drill pipe, displacing the well logging instrument thus exposed through the portion of the wellbore by connecting additional sections of drill pipe and lowering the drill pipe, and, during this displacing, continuously generating and sending uphole a signal indicative of the compressive load undergone by the well logging instrument.

U.S. Pat. No. 4,457,370 issued to Wittrisch describes a method for performing well logging or well servicing operations in a predetermined inclined or horizontal zone of a well following an initial vertical portion thereof. The method includes fastening a logging instrument or well servicing tool body at the end of a string of rods (such as drill pipe) lowered into the wellbore. The tool body includes an electrical connector. The method includes lowering, at the end of an electrical cable, from the Earth's surface, a mating connector adapted to fit the connector on the wellbore tool. Coupling the connectors is performed by the action of a force generated at least partly by the pressure of a fluid pumped through the pipe string, and supplying electric power through the cable and the joined connectors to the well logging or servicing tool for its operation in the predetermined zone.

U.S. Pat. No. 6,578,631 issued to Milne et al, describes a method of well logging in which the well logging instrument is delivered to the bottom of the well within a drill pipe and then the well is logged by withdrawing the drill pipe with the sensor portion of the well logging instrument protruding from the drill pipe. Following the logging operation, the well logging instrument is returned to the surface by reverse circulation.

U.S. Pat. No. 6,755,257 issued to Spencer et al. describes an apparatus and method for deploying a compact battery/memory well logging instrument for acquiring data in deviated or horizontal wellbores. A drill pipe assembly includes a drill pipe having secured at a downhole end thereof a delatching latching sub. The delatching sub contains an extendable running sub supporting a battery memory logging instrument. The running sub occupies an initial retracted position during deployment of the drill pipe, whereby well the logging instrument is protected within one or more drill pipe stands. The running sub is movable by a messenger to a second, extended position in which its logging instrument protrudes from the end of the drill pipe. The drill pipe assembly may therefore be used to protect the well logging instrument during running in operations, and then the logging instrument is extended out the end of the drill pipe for commencement of logging operations.

U.S. Pat. No. 6,269,891 issued to Runia discloses a system for drilling and logging of a wellbore drilled through subsurface formations. The system includes a well logging instrument string and a drill string having a longitudinal channel for circulation of drilling fluid. The drill string includes a port providing fluid communication between the channel and the exterior of the drill string. The channel and the port are arranged to allow the well logging instrument string to pass through the channel and from the channel through the port to a position exterior to the drill string. The system further includes a removable closure element adapted to selectively close the port, wherein the logging instrument string may be selectively connected to the closure element.

U.S. Patent Application Publication No. 2004/0118611 filed by Runia discloses a method of drilling a wellbore into subsurface formations is provided, including using a drill string which includes at its lower end a bottom hole assembly comprising a drill bit, a drill steering system, and a surveying system, wherein the drill string includes a passageway for an auxiliary tool to move from a first position interior of the drill string above the bottom hole assembly to a second position, wherein at least part of the auxiliary tool is exterior to the drill string below the bottom hole assembly. The passageway can be selectively closed. The method also includes drilling so as to progress the drill string into the formations until a tool operating condition is met; opening the passageway; passing an auxiliary tool from the first position through the passageway to the second position, and operating the auxiliary tool at the second position.

U.S. Pat. No. 7,134,493 issued to Runia discloses a well logging system that may be used in a wellbore. A tubular conduit extends from the Earth's surface into the wellbore and contains a body of wellbore fluid. A well logging instrument string may be passed from a position within the conduit to a position outside the conduit at a lower end part thereof, and may be suspended by the conduit in the position outside the conduit. A pressure pulse device is arranged within the conduit in a manner that the pressure pulse device is in data communication with the well logging instrument string. The pressure pulse device is capable of generating pressure pulses in the body of wellbore fluid, which pressure pulses represent data communicated by the well logging instrument string to the pressure pulse device during logging of earth formation by the well logging instrument string. The system further includes a control system in fluid communication with the body of wellbore fluid and arranged to receive the pressure pulses.

U.S. Patent Application Publication No. 2004/0238218 filed by Runia et al. discloses a method and system for introducing a fluid into a borehole, in which there is arranged a tubular drill string including a drill bit. The drill bit is provided with a passageway between the interior of the drill string and the borehole, and with a removable closure element for selectively closing the passageway in a closing position. There is further provided a fluid injection tool comprising a tool inlet and a tool outlet. A method disclosed in the '218 publication includes passing the fluid injection tool through the drill string to the closure element, and using it to remove the closure element from the closing position; passing the fluid injection tool outlet through the passageway, and introducing the fluid into the borehole from the interior of the drill string through fluid injection tool into the borehole.

There continues to be a need for well logging instrument conveyance methods and apparatus that reduce the risk of damage to the well logging instruments and increase the reliability of moving the logging instruments into and out of wellbores where wellbore conditions make instrument conveyance difficult and risky.

SUMMARY OF THE INVENTION

One aspect of the invention is a well logging instrument deployment device. A well logging instrument deployment device according to this aspect of the invention includes a housing configured to be coupled to a pipe string. A carrier sub is disposed inside the housing and configured to move longitudinally inside the housing. At least one well logging instrument is coupled to the carrier sub. A latch is configured to retain the well logging instrument and carrier sub in a first longitudinal position along the housing such that the well logging instrument is disposed entirely inside the housing. The latch is configured to retain the well logging instrument and carrier in a second position such that at least a portion of the well logging instrument extends outwardly from the housing.

A method for well logging according to another aspect of the invention includes inserting a well logging instrument into a conveyance device coupled to a pipe string. The pipe string is inserted into a wellbore. A fluid is pumped into the pipe string to extend the well logging instrument beyond an end of the conveyance device. The pipe string is withdrawn from the wellbore while operating the well logging instrument.

Other aspects and advantages of the invention will be apparent from the following description and the appended claims.

DETAILED DESCRIPTION

Figure 1:
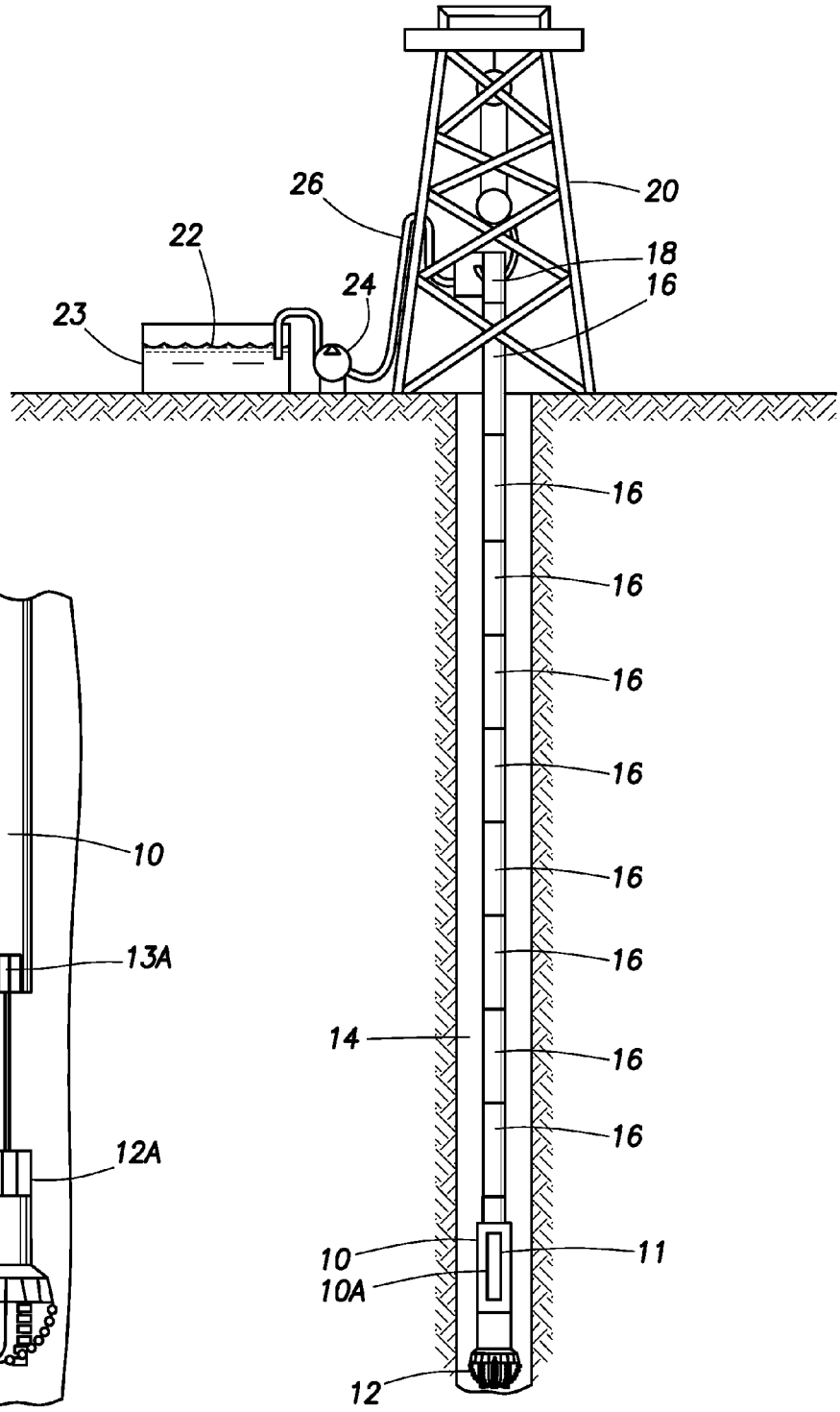
FIG. 1 shows a well logging instrument disposed in one example of a deployment device coupled to a drill string disposed in a wellbore.

As example of a well logging instrument deployment device as it may be used with a drill string in a wellbore is shown at 10 in FIG. 1. The deployment device 10 may include a housing 10A formed from steel or other high strength metal, or, in some examples, from a non-magnetic alloy such as titanium, monel or an alloy sold under the trademark INCONEL, which is a registered trademark of Huntington Alloys Corporation, Huntington, W. Va. The housing 10A may include threaded couplings (not shown separately) to enable coupling the housing 10A proximate the lower end of a drill string, which in the present example is formed by threadedly coupling end to end segments ("joints") of drill pipe, shown at 16. The lowermost end of the deployment device 10 may be coupled in one example to a drill bit 12 which is used to drill through the subsurface formations to create the wellbore 14. The coupling to the drill bit 12 will be further explained below with reference to FIG. 2.

The housing 10A includes in an interior passage one or more well logging instruments 11. The type and number of well logging instruments is not intended to limit the scope of this invention, and such well logging instruments may be any type known in the art. As a practical matter, the well logging instruments 11 may be of types generally used to make measurements of various physical properties of the Earth formations penetrated by a wellbore 14 wherein the wall of the wellbore 14 is exposed. Such instruments are known in the art as "open-hole" well logging instruments.

The drill string may be coupled at its upper end to a top drive 18 of any type well known in the art. The top drive 18 can provide rotational power to turn the drill string, thus rotating the drill bit 12 to drill through the formations and lengthen the wellbore 14. The top drive 18 may be moved up and down by hoisting devices (not shown separately) disposed in a drilling rig 20 of any type well known in the art.

Drilling fluid 22 may be stored in a tank 23 or pit. The drilling fluid 22 is lifted from the tank 23 by a pump 24, the outlet of which is coupled to a "stand pipe" 26. The stand pipe 26 is hydraulically connected to the top drive 18, wherein the drilling fluid 22 under pressure from the pump 24 is moved through the interior of the drill string, to the deployment device 10 and ultimately out from nozzles or "jets" (not shown) in the drill bit 12 and into the wellbore 14. As is well known in the art, the drilling fluid 22 is used for, among other purposes, to lift cuttings created by the drill bit 12, to cool and lubricate the drill bit 12, and to provide hydrostatic pressure to prevent entry of fluids into the wellbore 14 from the drilled formations. In other examples and as will be further explained with reference to FIGS. 3 and 4, the drill bit 12 may be substituted by a nose, plug or similar device.

The deployment device 10 is shown in FIG. 1 in its retracted position, wherein the well logging instruments 11 are disposed mostly or entirely inside the interior of the housing 10A. Whether the deployment device 10 is used during drilling operations, as is the example shown in FIG. 1, or as may be the case with other implementations during insertion of the drill string into the wellbore 14 ("tripping in"), the configuration of the deployment device 10 will typically be retracted as shown in FIG. 1.

Figure 2:
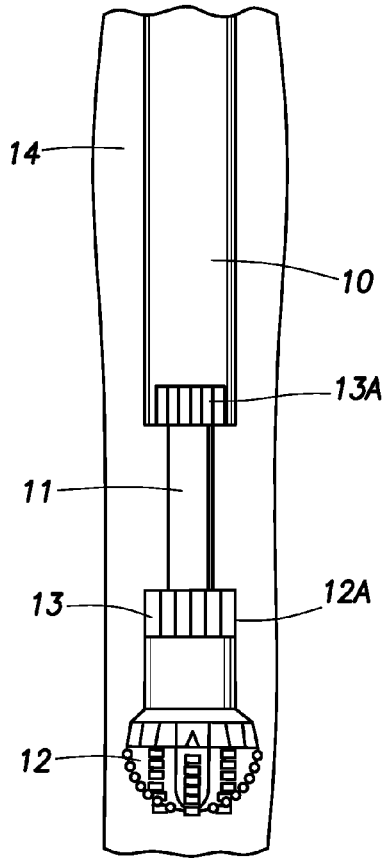
FIG. 2 shows the example device of FIG. 1 wherein the well logging instrument is deployed out of the end of the drill string for logging the wellbore.

FIG. 2 shows the deployment device 10 in an extended position wherein the well logging instruments 11 are deployed out from the end of the drill string by extending them outwardly from the end of the housing 10A. The manner in which, and internal devices for performing such extension will be further explained below with reference to FIGS. 3 and 4. In FIG. 2, a lower end of the well logging instruments 11 may be coupled to a "bit box" 12A which may include a threaded internal opening (not shown in FIG. 2) to receive a threaded coupline or "pin" (not shown) on the end of the drill bit 12. When the deployment device 10 is retracted, splines 13 formed in the exterior of the bit box 13 may engage corresponding splines 13A on the interior of the housing 10A so that torque and axial loading may be transferred through the housing 10A from the drill string to the drill bit 12 without affecting the well logging instruments 11.

Figure 5:
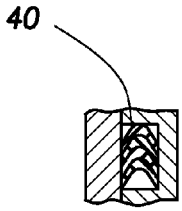
FIG. 5 shows one example of a blowout preventer packing.

Example internal components of a deployment device will now be explained with reference to FIG. 3 (retracted position) and FIG. 4 (extended position). First referring to FIG. 3, the housing 10A is shown as being threadedly coupled to the lowermost joint of drill pipe 16. Flow of the drilling fluid (22 of FIG. 1) during operation is indicated by the arrows inside the housing 10A. An uppermost portion of the deployment device 10 may include a flapper valve 34 that performs the function of limiting flow of fluid to the direction indicated by the arrows. The flapper valve 34 may prevent fluid from being forced up the inside of the drill string in the event a formation is encountered that has higher fluid pressure than the total drilling fluid pressure inside the drill string. A carrier sub 35, which may be shaped substantially cylindrically on its exterior surface is configured to move longitudinally along an interior bore (10B in FIG. 4) of the housing 10A. The carrier sub 35 may include a calibrated fluid flow orifice 30. The calibrated orifice 30 is configured to generate a selected pressure drop at a selected flow rate to operate a latching device as will be further explained below. The well logging instruments 11 are shown coupled to the lower end of the carrier sub 35. The carrier sub 35 may include proximate the calibrated orifice 30 a blow out preventer plug (see 40 in FIG. 5) to limit to stop movement of fluid in a direction reverse to that shown by the arrows in FIG. 3.

Disposed circumferentially about the lower end of the carrier sub 35 may be a plurality of latch fingers or "collets" 31. The collets 31 can be formed from resilient metal such as copper-beryllium alloy, titanium or similar material and configured to bias the lower ends of the collets 31 radially outwardly. The lower ends of the collets 31 are shaped to mate into a corresponding "profile" 33A disposed in a latch base 33 affixed to the interior of the housing 10A proximate its lower end. The latch base 33 may include one or more passages 33C for flow of the drilling fluid.

Figure 3:
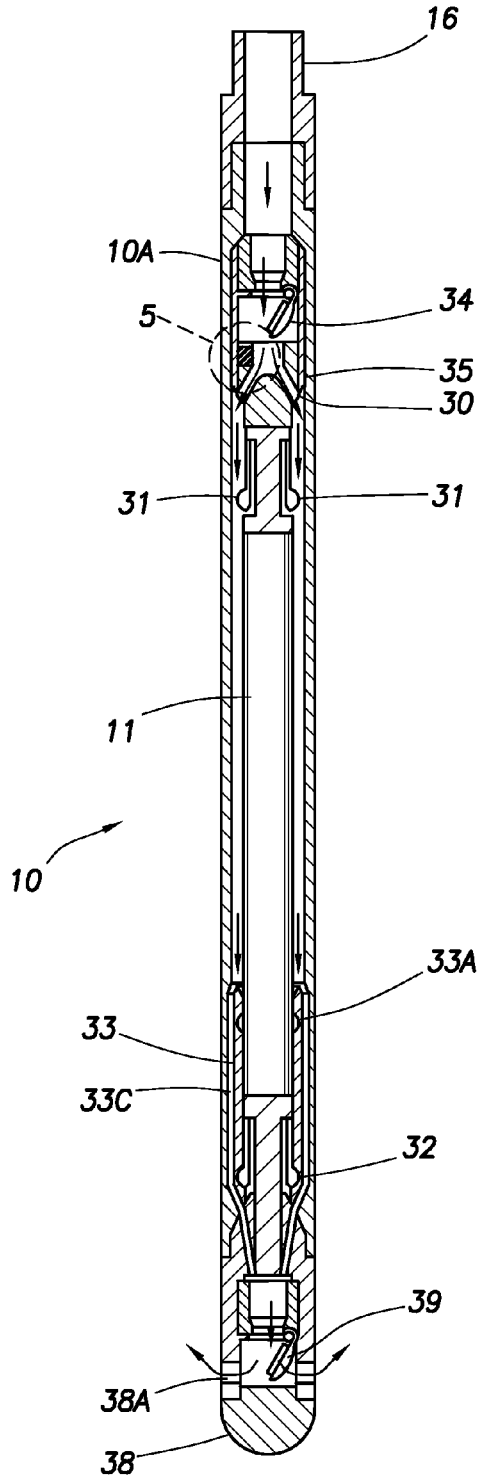
FIG. 3 shows one example of a deployment device in a retracted position.
Figure 4:
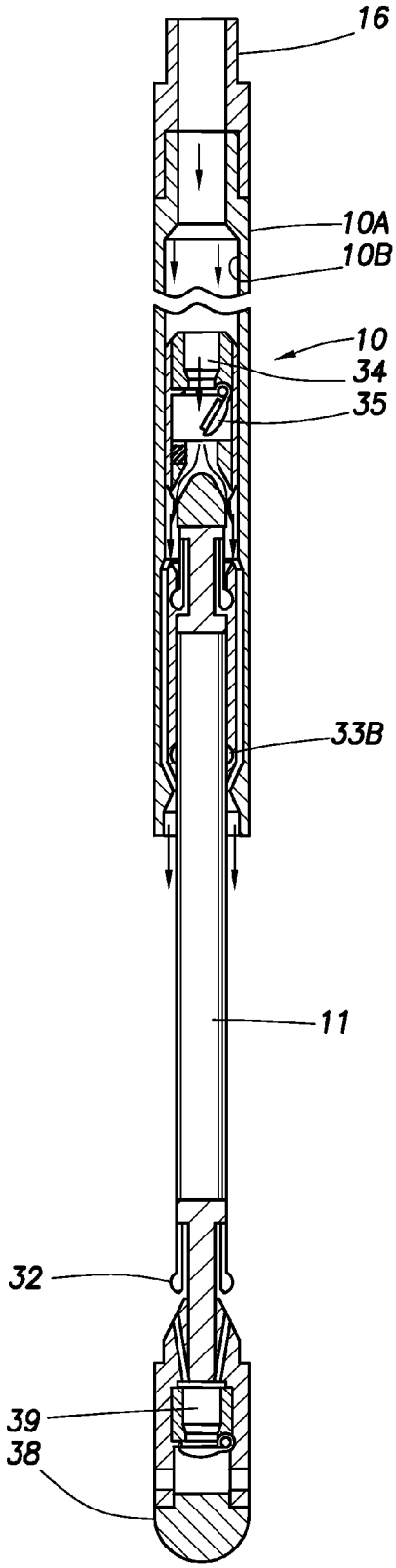
FIG. 4 shows the example device of FIG. 3 in an extended position.

In the retracted position shown in FIG. 3, latch collets (see 32 in FIG. 4 for an exploded view) which may be formed substantially similarly to the collets 31 in the upper part of the device 10 are disposed proximate the bottom end of the logging instruments 11 and are locked into a mating profile (see 33B in FIG. 4 for an exploded view) in the latch base 33. Drilling fluid ultimately can exit the deployment device 10 through ports 38A on a bottom nose 38 coupled to the lower end of the logging instruments 11. If the deployment device 10 includes a drill bit (see 12 in FIG. 2) at the lower end, drilling fluid would typically be discharged through jets, nozzles or courses in the drill bit. In the present example, the nose 38 may include a safety valve (39 in FIG. 4) to stop fluid from entering the device 10 in the event of unforeseen pressure in certain subsurface formations.

To operate the device 10 to extend the logging instruments 11 from the housing 10A, the drill string is lifted from the bottom of the wellbore to provide sufficient wellbore length below he nose 38 (or drill bit 12) to fully extend the logging instruments 11. The pump (24 in FIG. 1) is operated such that a pressure is exerted by the drilling fluid on the carrier sub 35 which when transmitted along the logging instruments 11 exceeds the holding capacity of the lower collets (32 in FIG. 4) in the lower latch profile 33B. Once the collets 32 are unlatched from the profile 33B, continues movement of the drilling fluid causes the entire assembly of the carrier sub 35, logging instruments 11 and nose 38 to be moved downwardly with respect to the housing 10A. When the upper collets 31 reach the mating profile 33A in the latch base 33, the upper collets 31 lock in the profile 33A. Thus, the logging instruments 11 are prevented from further movement out from the housing 10A. The exposed portion of the well logging instruments 11 may include one or more sensors (not shown) that are suited to make measurements of one or more formation parameters in "open hole."

The drill string may then be withdrawn from the wellbore (14 in FIG. 1) by successively removing joints or stands (two or three assembled joints) of the drill pipe 16. As the drill string is withdrawn from the wellbore, the sensors (not shown) in the well logging instruments 11 may make measurements of various physical properties of the formations outside the wellbore (14 in FIG. 1). A time-indexed record of such measurements may be made by a recording device (not shown) disposed in or associated with the well logging instruments 11 during removal of the drill string from the wellbore. Such record may be correlated to depth in the wellbore by making a time indexed record (using equipment at the Earth's surface) of depth of the lowermost end of the logging instruments 11 in the wellbore and correlating the time-depth record to the time indexed record of measurements made in the logging instruments 11. In other examples, a controllable orifice or valve (not shown) may be included in the well logging instruments 11 to modulate flow of the drilling fluid (22 in FIG. 1) to communicate signals corresponding to the various measurements to the Earth's surface. Such signals may be detected by measuring the drilling fluid pressure at the surface and demodulating the signals from the pressure measurements. See, for example, U.S. Pat. No. 5,519,668 issued to Montaron and assigned to the assignee of the present invention.

The upper collets 31 preferably exert a locking force that can be overcome by axially compressing the nose 38 against the bottom of the wellbore or other stop. An amount of axial compression needed to overcome the locking force is preferably less than the compressive load limit of the well logging instruments 11 to prevent damage thereto. Thus, the example shown and explained above with reference to FIGS. 1 and 2, that includes a drill bit at the bottom end, may be used to drill the wellbore, make measurements of various formation properties, and again drill the wellbore by reinserting the well logging instruments 11 inside the housing 10A.

Well logging deployment devices and method according to the various aspects of the invention may enable relatively safe deployment of well logging instruments into wellbores that otherwise present difficulties to such deployment. Such devices and methods may enable the use of existing well logging instruments configured for wireline deployment without the need to substantially reconfigure such instruments. Certain examples of such deployment devices and methods may enable a wellbore to be longitudinally extended and logged again afterward in the event it is determined that such extension is necessary.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A well logging instrument deployment device, comprising:

a housing configured to be coupled to a pipe string;

a carrier sub disposed inside the housing and configured to move longitudinally inside the housing;

at least one well logging instrument coupled to the carrier sub and not connected to a wireline cable; and a latch assembly configured to retain the well logging instrument and carrier sub in a first longitudinal position along the housing such that the well logging instrument is disposed entirely inside the housing, the latch assembly also configured to retain the well logging instrument and carrier sub in a second longitudinal position such that at least a portion of the well logging instrument extends outwardly from the housing.

2. The deployment device of claim 1 wherein the latch assembly comprises a latch base affixed inside the housing, upper collets disposed circumferentially around the carrier sub, and lower collets disposed circumferentially proximate the bottom of the well logging instrument, the latch base including a first profile configured to lockingly receive the upper collets therein when the well logging instrument is disposed entirely inside the housing, the latch base including a lower latch profile configured to lockingly receive the lower collets when the well logging instrument is extended from the end of the housing.

3. The deployment device of claim 2 wherein the lower collets are biased to disengage when a compressive force on the well logging instruments exceeds a preselected amount lower than a maximum axial loading on the well logging instrument.

4. The deployment device of claim 1, wherein the latch assembly is further configured to retain the well logging instrument and carrier sub in the first longitudinal position as the pipe string is conveyed into a wellbore.

5. The deployment device of claim 1 wherein the latch assembly interlockingly retains the well logging instrument in the first longitudinal position.

6. The deployment device of claim 1 wherein the latch assembly interlockingly retains the well logging instrument in the second longitudinal position.

7. The deployment device of claim 1 wherein the latch assembly bi-directionally retains the well logging instrument in the first longitudinal position and bi-directionally retains the well logging instrument in the second longitudinal position.

8. The deployment device of claim 1 wherein the latch assembly comprises a first latch which bi-directionally retains the well logging instrument in the first longitudinal position and a second latch which bi-directionally retains the well logging instrument in the second longitudinal position.

9. A well logging instrument deployment device, comprising:

a housing configured to be coupled to a pipe string;

a carrier sub disposed inside the housing and configured to move longitudinally inside the housing;

at least one well logging instrument coupled to the carrier sub; and a latch assembly configured to retain the well logging instrument and carrier sub in a first longitudinal position along the housing such that the well logging instrument is disposed entirely inside the housing, the latch assembly also configured to retain the well logging instrument and carrier sub in a second longitudinal position such that at least a portion of the well logging instrument extends outwardly from the housing, wherein the carrier sub comprises a check valve to prevent flow of fluid into the pipe string from below the housing.

10. A well logging instrument deployment device, comprising:

a housing configured to be coupled to a pipe string;

a carrier sub disposed inside the housing and configured to move longitudinally inside the housing;

at least one well logging instrument coupled to the carrier sub;

a latch assembly configured to retain the well logging instrument and carrier sub in a first longitudinal position along the housing such that the well logging instrument is disposed entirely inside the housing, the latch assembly also configured to retain the well logging instrument and carrier sub in a second longitudinal position such that at least a portion of the well logging instrument extends outwardly from the housing; and a bit box coupled proximate a lower end of the well logging instrument, the bit box configured to receive a threaded coupling on a drill bit, the bit box including features configured to transmit torque and axial loading to the housing when the well logging instrument is disposed entirely inside the housing.

11. The deployment device of claim 10 wherein the features comprise splines.

12. A method for well logging, comprising:

inserting a well logging instrument into a deployment device coupled to a pipe string;

inserting the pipe string into a wellbore;

pumping a fluid into the pipe string to extend the well logging instrument beyond an end of the deployment device, wherein the pumping comprises increasing a pressure of the fluid to cause release of a latch holding the logging instrument inside the deployment device; and withdrawing the pipe string from the wellbore while operating the well logging instrument.

13. The method of claim 12 further comprising prior to extending the well logging instrument, rotating at least a portion of the pipe string to turn a drill bit coupled to the pipe string below the deployment device to lengthen the wellbore.

14. The method of claim 13 further comprising, after at least partially withdrawing the pipe string from the wellbore, applying axial force to the drill bit to reinsert the well logging instrument into the deployment device, and resuming the rotating at least the portion of the pipe string to lengthen the wellbore.

15. The method of claim 12 wherein the well logging instrument is inserted into the deployment device proximate the earth's surface.

16. The method of claim 12 further comprising:

after the withdrawing the pipe, moving the pipe to the bottom of the wellbore to reinsert the well logging instrument into the interior of the pipe;

applying longitudinal force to and rotating a drill bit disposed proximate the bottom of the pipe string to extend the wellbore;

lifting the pipe string a selected distance from the bottom of the wellbore and repeating the pumping to extend and withdrawing the pipe string while operating the well logging instruments to measure at least part of the longitudinally extended portion of the wellbore.

17. A method for well logging, comprising:

inserting a well logging instrument into a housing coupled to a pipe string;

providing a latch configured to retain the well logging instrument in a retracted position, wherein the well logging instrument is disposed inside the housing, inserting the pipe string into a wellbore;

pumping a fluid into the housing to release the latch, allowing the well logging instrument to move from the retracted position to an exposed position, wherein at least a portion of the well logging tool extends beyond an end of the housing; and withdrawing the pipe string from the wellbore while operating the well logging instrument.

18. A well logging instrument deployment device, comprising:

a housing configured to be coupled to a pipe string;

at least one well logging instrument moveable relative to the housing;

a latch assembly configured to bi-directionally retain the well logging instrument in a first longitudinal position along the housing such that the well logging instrument is disposed entirely inside the housing, the latch assembly also configured to bi-directionally retain the well logging instrument in a second longitudinal position such that at least a portion of the well logging instrument extends outwardly from the housing.

19. A method for well logging, comprising:

inserting a well logging instrument into a deployment device coupled to a pipe string;

inserting the pipe string into a wellbore;

pumping a fluid into the pipe string to extend the well logging instrument beyond an end of the deployment device;

withdrawing the pipe string from the wellbore while operating the well logging instrument, and rotating at least a portion of the pipe string to turn a drill bit coupled to the pipe string below the deployment device to lengthen the wellbore prior to extending the well logging instrument.

* * * * *